United States Patent [19]

Gallagher

[11] Patent Number: 5,005,799

[45] Date of Patent: Apr. 9, 1991

[54] PATTERNS FOR DETERMINING THE PROFILE OF AN ARCH

[76] Inventor: Anthony Gallagher, 65 Hazlewick Road, Three Bridges, Crawley, West Sussex, England

[21] Appl. No.: 325,638

[22] Filed: Mar. 20, 1989

[30] Foreign Application Priority Data

Mar. 19, 1988 [GB] United Kingdom ..... 8806587

[51] Int. Cl.[5] ..... E04G 13/00

[52] U.S. Cl. ..... 249/19; 52/88; 52/89; 52/747; 249/53 R; 249/175; 249/209; 264/32

[58] Field of Search ..... 249/19, 31, 32, 50, 249/53 R, 61, 83, 115, 175, 176, 183, 209; 52/88, 89, 747, 749; 264/32

[56] References Cited

U.S. PATENT DOCUMENTS

| | | | |
|---|---|---|---|
| 1,391,748 | 9/1921 | Mayberry | 249/31 |
| 1,730,472 | 10/1929 | Murray | 249/183 |
| 3,292,338 | 12/1966 | MacClarence et al. | 264/32 |
| 4,325,207 | 4/1982 | Russell et al. | 249/209 |

FOREIGN PATENT DOCUMENTS

| | | | |
|---|---|---|---|
| 1198607 | 12/1985 | Canada | 249/209 |
| 641535 | 8/1950 | United Kingdom | 52/89 |
| 1424584 | 2/1976 | United Kingdom | 249/32 |
| 2063953 | 6/1981 | United Kingdom | 52/89 |

*Primary Examiner*—James C. Housel
*Attorney, Agent, or Firm*—Kinney & Lange

[57] ABSTRACT

A pattern for defining the profile of an arch is produced from a unitary block of material or materials having the required structural strength to support the arch materials during construction and sufficient ductility or resilience at its surface to accommodate irregularities present in the arch materials. The pattern may be produced from a single block of polystyrene material whose upper profile corresponds to the desired underside of an arch to be constructed using the pattern and whose undersurface is generally flat.

5 Claims, 2 Drawing Sheets

PATTERNS FOR DETERMINING THE PROFILE OF AN ARCH

FIELD OF THE INVENTION

This invention relates to patterns for determining the profile of an arch and, more especially, patterns which can be used in situ by both skilled and unskilled artisans for defining the underside profile of an arch spanning a passageway or the like. The invention has particular application in the construction of brick arches for gardens and as internal features of houses, restaurants and the like.

When constructing a brick arch it is customary to produce a pattern comprising a sheet of wood bent to the appropriate required profile about a structure consisting of a wooden base plate and a series of angled struts extending upwardly from the base plate. The construction of such a pattern is time consuming and requires a high degree of skill to ensure that the profile defined by its periphery corresponds to the desired profile of the underside of the arch. Additionally, the pattern, when constructed, is difficult to site because of its weight. Furthermore, its relatively hard surface means that any imperfections in bricks or mortar laid about its periphery are reflected as protuberances from the upper profile of the arch when constructed. Other conventional patterns which comprise an assembly of adjacent suitably shaped pieces lack both the necessary coherence or structural strength to achieve the pleasing appearance normally associated with brick arches.

The present invention sets out at least to alleviate the disadvantages referred to above.

SUMMARY OF THE INVENTION

According to the present invention in one aspect, there is provided a pattern for defining the profile of an arch, the pattern comprising a unitary structure having an upper surface whose contour complements the contour of the under profile of the arch to be constructed and a generally flat under surface and being produced from a material or materials having the required structural strength to support the arch materials during construction of the arch and having sufficient ductility or resilience (i.e. deformable) at its surface to accommodate irregularities present in the arch materials.

In a preferred embodiment, the pattern is produced from a unitary block of polystyrene material whose upper profile corresponds to the desired underside of the arch to be constructed using the pattern.

The polystyrene block may be mounted on a rigid base and its upper surface may be coated with a release agent prior to use. One or each side face of the polystyrene block may be suitably marked to indicate the brick spacing to be employed.

According to the present invention in another aspect, there is provided a method of constructing a brick arch which comprises the steps of positioning a series of bricks and interposed mortar about the profile of a pattern comprising a unitary block of polystyrene material having an upper profile which corresponds to the desired underside of the arch to be constructed and a generally flat under surface which is supported at least at its ends by upstanding supports, the bricks being positioned with their side or end faces in contact with the upper profile of the pattern, and removing the pattern from the brick arch once the mortar has, at least partially, set.

BRIEF DESCRIPTION OF THE DRAWINGS

The invention will now be described by way of example only with reference to the accompanying diagrammatic drawings in which.

DESCRIPTION OF THE PREFERRED EMBODIMENT OF THE INVENTION

Figure 1:
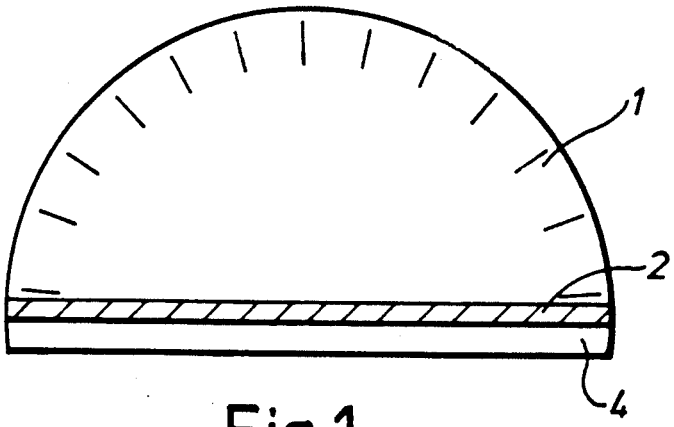
FIG. 1 is a front elevational view of a pattern in accordance with the invention.
Figure 2:
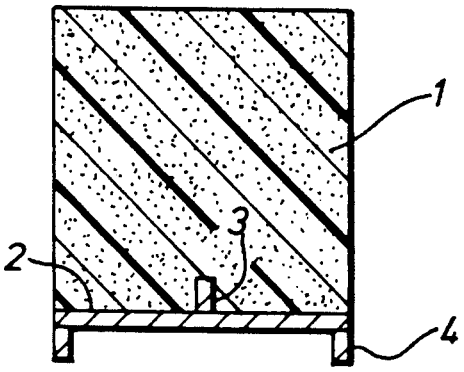
FIG. 2 is a side elevational view of the pattern illustrated in FIG. 1.

The pattern 1 illustrated in FIGS. 1 and 2 is constructed essentially from a unitary block of polystyrene and is formed on its upper surface with an arcuate profile which corresponds to the desired profile of the underside of an arch to be constructed with the assistance of the pattern. The under surface of the pattern 1 is generally flat. The width of the pattern is at least equal to the required arch width. It will, of course, be appreciated that the pattern width may, in some cases, be greater than the required arch width.

The profile adopted for the pattern may take any form or shape as may the length, width and profile height above the pattern base. Thus the profile may, for example, be arcuate, elliptical, pointed or castellated. Examples of specific arches include lancet, half round, gothic, segmetal, eliptical, indian and flat arches.

Further, the pattern may be supplied in any standard length and/or width, typical widths by 4" (100 mm) and 9" (225 mm). The patterns may be stamped direct from a suitable sheet of material and may be supplied in a variety of designs and sizes.

As will be seen from FIGS. 1 and 2, the pattern 1 may include a rigid base 2 formed of any suitable material such as wood, metal or plastics. The base may include an inverted elongate T member 3 standing proud of its surface to provide enhanced keying and strength characteristics for the pattern; in addition, lengthwise extending side pieces 4 may be provided to enhance the rigidity of the base 2.

In use, the pattern may be supported in situ at its ends by any suitable support structure. The surface of the pattern 1 may then be coated with a suitable release material before laying the required bricks and mortar about the pattern profile. The bricks are laid about the pattern with their side or end faces in contact with the upper surface of the pattern. Once the bricks have been so laid and the mortar has at least partially set, the pattern can be removed, the arch at this time being self supporting.

When applying the bricks to the pattern, imperfections or protrusions present in the under surface of the bricks or mortar can be pressed into the exterior pattern surface so that the upper arch profile is of the appropriate contour. The ability to accommodate such imperfections and protrusions is, as will be appreciated, due to the inherent ductility or resilience of the polystyrene material from which the pattern is made.

One or each side face of the pattern may include markings as shown to indicate to the user the spacings to be adopted for the bricks. These markings may be screen printed onto the pattern.

Figure 3:
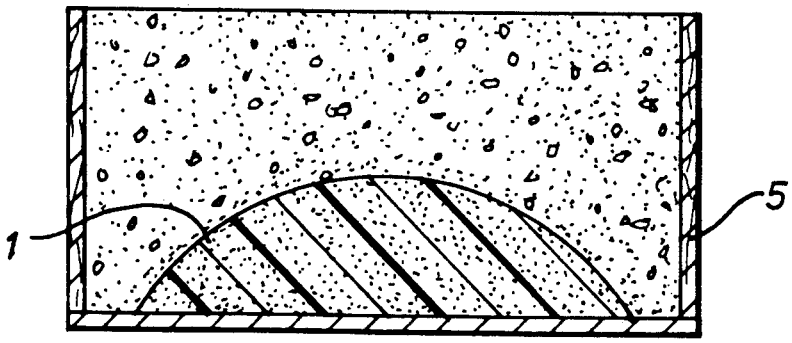
FIG. 3 is a front elevational view in section of a pattern in accordance with the invention in use when casting an arch from cement or concrete.

In the embodiment illustrated in FIG. 3, a suitably profiled polystyrene pattern 1 is shown positioned within a shuttered wooden mould 5. The shuttering of the mould extends above the height of the pattern 1 so that, when concrete or cement is cast into the mould 5 around and above the upper surface of the pattern, an arch of the appropriate profile is formed. The periphery of the pattern may again be coated with a release agent prior to casting so that the pattern can readily be removed from the arch for when solidified re-use at a later time. The extremities of the pattern extend to positions inboard from the ends of the mould so that end supports are formed in the cast arch for support purposes.

Figure 4:
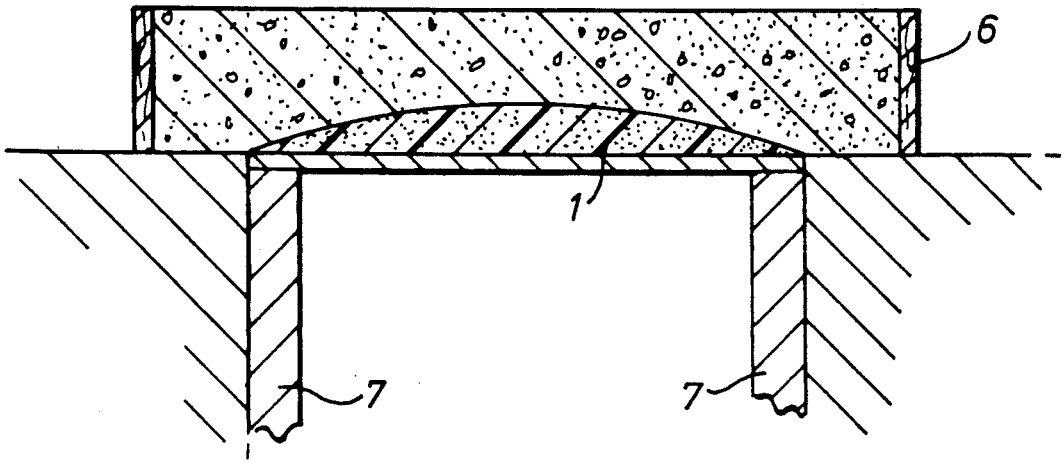
FIG. 4 is a front elevational view of a pattern in accordance with the invention in use when casting an arch from cement or concrete in situ.

In the arrangement illustrated in FIG. 4, the arch is cast in situ at the location where it is to be sited. In this embodiment, open-ended mould shuttering 6 is used to define the side extremities of the formed arch, the pattern 1 being positioned within the shuttering 6 and supported by props 7.

Figure 5:
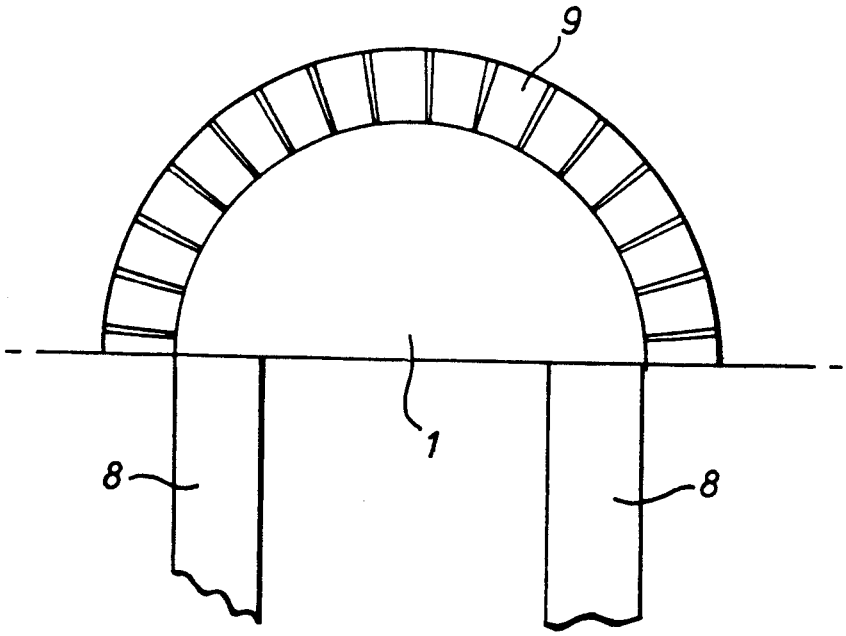
FIG. 5 is a front elevational view of a pattern in accordance with the invention in use when constructing a brick arch.

In FIG. 5, a brick arch is shown constructed about the upper profile of the pattern 1, the pattern being supported at its ends by upstanding supports 8. The bricks 9 are laid onto the pattern with their side faces in contact with the upper surface of the pattern. The invention has particular application to the construction of such arches, especially arches for gardens and as features inside houses, restaurants and outer buildings. It also has application in the construction of arched fireplaces constructed of bricks.

It will be appreciated that the foregoing is exemplary of patterns for defining the profile of arches in accordance with the invention and that modifications can readily be made thereto without departing from the true scope of the invention.

I claim:

1. A pattern for defining a profile of an arch, the pattern having sufficient strength for supporting a brick arch during construction thereof and comprising a unitary block of material having a deformable upper surface whose contour complements the profile of the arch, a generally flat under surface, and a first side face which includes markings to indicate to the user respective locations of bricks to be laid about the upper surface of the pattern.

2. The pattern of claim 1 wherein the unitary block of material is a polystyrene block.

3. The pattern of claim 2 wherein the polystyrene block is mounted on a rigid base.

4. The pattern of claim 1 wherein the upper surface is coated with a release agent.

5. The pattern of claim 1 and further comprising a second side face which includes markings to indicate to the user respective locations of bricks to be laid about the upper surface of the pattern.

* * * * *